US011801961B2

(12) United States Patent
Dersch

(10) Patent No.: US 11,801,961 B2
(45) Date of Patent: Oct. 31, 2023

(54) TWIN-TUBE BAG FORMING, FILLING AND SEALING MACHINE COMPRISING METERING DEVICE AND TRANSFER SYSTEM

(71) Applicant: ROVEMA GMBH, Fernwald (DE)

(72) Inventor: Volker Dersch, Grünberg (DE)

(73) Assignee: ROVEMA GMBH, Fernwald (DE)

( * ) Notice: Subject to any disclaimer, the term of this patent is extended or adjusted under 35 U.S.C. 154(b) by 142 days.

(21) Appl. No.: 17/428,773

(22) PCT Filed: Feb. 5, 2020

(86) PCT No.: PCT/EP2020/052802

§ 371 (c)(1),
(2) Date: Aug. 5, 2021

(87) PCT Pub. No.: WO2020/161157

PCT Pub. Date: Aug. 13, 2020

(65) Prior Publication Data

US 2022/0106069 A1 Apr. 7, 2022

(30) Foreign Application Priority Data

Feb. 8, 2019 (DE) ..... 10 2019 103 184.2

(51) Int. Cl.
*B65B 65/00* (2006.01)
*B65B 1/12* (2006.01)
(Continued)

(52) U.S. Cl.
CPC ..... *B65B 65/006* (2013.01); *B65B 1/12* (2013.01); *B65B 1/32* (2013.01); *B65B 1/36* (2013.01);
(Continued)

(58) Field of Classification Search
CPC .... B65B 1/12; B65B 1/32; B65B 1/36; B65B 9/20; B65B 35/04; B65B 35/08;
(Continued)

(56) References Cited

U.S. PATENT DOCUMENTS 1,686,787 A * 10/1928 Bates ..... B65B 9/15 53/469
2,200,971 A * 5/1940 Sonneborn et al. .... B65B 9/213 53/410
(Continued)

FOREIGN PATENT DOCUMENTS

CN 107215507 A * 9/2017 ..... B65B 37/005
CN 108502253 A 9/2018
(Continued)

OTHER PUBLICATIONS

PCT English Language Translation of the International Preliminary Report on Patentability, PCT/EP2020/052802, dated Aug. 19, 2021, 10 pages.
(Continued)

*Primary Examiner* — Stephen F. Gerrity
(74) *Attorney, Agent, or Firm* — Quarles & Brady LLP

(57) ABSTRACT

A twin-tube tubular bag machine having two longitudinal sealing elements for forming two parallel film tubes, two parallel transverse sealing jaws for forming sealed tubular bags, and two filling devices for filling the tubular bags. A dosing device is disposed upstream of each of the filling devices for dosing a prespecified filling quantity of the filling material to be filled into the tubular bags. A transfer element having several transfer containers is provided between the filling devices and the dosing device. The filling material is transferred from the dosing device to the transfer containers in an input station. The transfer containers are transported to a pairing of two dispensing stations along a transfer line, the filling material is transferred from the
(Continued)

transport containers to the two filling devices, and the transfer containers are transported back to the input station along a return transfer line.

11 Claims, 4 Drawing Sheets

(51) Int. Cl.

| | |
|---|---|
| ***B65B 1/32*** | (2006.01) |
| ***B65B 1/36*** | (2006.01) |
| ***B65B 9/20*** | (2012.01) |
| ***B65B 37/00*** | (2006.01) |
| ***B65B 59/04*** | (2006.01) |

(52) U.S. Cl.
CPC ..... *B65B 9/20* (2013.01); *B65B 37/005* (2013.01); *B65B 59/04* (2013.01); *B65B 2210/02* (2013.01); *B65B 2220/14* (2013.01)

(58) Field of Classification Search
CPC ..... B65B 37/005; B65B 37/16; B65B 37/18; B65B 59/04; B65B 65/006; B65B 2210/02; B65B 2220/14
USPC ..... 53/202, 546, 552
See application file for complete search history.

(56) References Cited

U.S. PATENT DOCUMENTS

| | | | | | |
|---|---|---|---|---|---|
| 2,237,119 | A * | 4/1941 | Smith | B65B 9/213 | 53/546 |
| 2,827,742 | A * | 3/1958 | Bursak | B65B 9/023 | 53/546 |
| 3,256,673 | A * | 6/1966 | Tew et al. | B65B 9/213 | 53/551 |
| 3,861,121 | A * | 1/1975 | Monsees | B65B 9/213 | 53/239 |
| 5,235,794 | A * | 8/1993 | Center | B65B 9/213 | 53/437 |
| 8,122,893 | B2 * | 2/2012 | Boldrini | B65B 9/213 | 53/202 |
| 8,656,690 | B2 * | 2/2014 | Bierschenk et al. | B65B 9/20 | 53/437 |
| 10,737,403 | B2 * | 8/2020 | Bauer et al. | B65G 47/647 | |
| 2017/0113825 | A1 | 4/2017 | Naoi et al. | | |

FOREIGN PATENT DOCUMENTS

| | | | | |
|---|---|---|---|---|
| DE | 1152942 | B | 8/1963 | |
| DE | 1228553 | B | 11/1966 | |
| DE | 4427346 | A1 | 2/1996 | |
| DE | 29911848 | U1 | 11/2000 | |
| DE | 102011106352 | A1 | 1/2013 | |
| DE | 102014219448 | A1 | 3/2016 | |
| WO | 2004106165 | A1 | 12/2004 | |
| WO | WO-2005113218 | A1 * | 12/2005 | B29C 65/08 |

OTHER PUBLICATIONS

PCT International Search Report, PCT/EP2020/052802, Jul. 3, 2020, 11 pages.

* cited by examiner

TWIN-TUBE BAG FORMING, FILLING AND SEALING MACHINE COMPRISING METERING DEVICE AND TRANSFER SYSTEM

This application represents the national stage entry of PCT International Application No. PCT/EP2020/052802 filed on Feb. 5, 2020, which claims the benefit of German Patent Application No. IO 2019 103 184.2 filed on Feb. 8, 2019, the entire contents of which are incorporated herein by reference for all purposes.

The disclosure relates to a tubular bag machine comprising a dosing device as used for the packaging of filling material.

The tubular bag machine is formed in the manner of a twin-tube tubular bag machine and is thus equipped with two longitudinal sealing elements for forming two parallel film tubes. These two film tubes are each sealed transversely in the tubular bag machine by means of two transverse sealing jaws which are moveable against each other and which thereby transversely seal the film tube, such that two strands of tubular bags can be produced continuously or intermittently. Before the tubular bags are sealed, the tubular bags are filled with the filling material by means of one filling device each. After the tubular bags have been sealed transversely, the individual tubular bags are separated from each other by means of a separating element.

In known twin-tube tubular bag machines, a dosing device is disposed upstream of the filling device. Portions of the filling material are each separated in the dosing device in order to fill the two filling devices of the twin-tube tubular bag machine with the prespecified quantities, for example a prespecified filling weight, a prespecified filling volume or a prespecified filling amount. In the known tubular bag machines, the dosing device operates synchronously to the tubular bag machine in order for the filling device to be able to fill the amount of filling material required for the filling of the tubular bag at each exact required point in time. This synchronous operation between the dosing device and the tubular bag machine increasingly leads to problems.

A first disadvantage of the synchronous operation between the dosing device and the tubular bag machine is that each little process interference during the dosing in the dosing device leads to a standstill or to an idle cycle in the twin-tube tubular bag machine. In particular in the case of high-performance tubular bag machines with a performance of more than 400 tubular bags per minute, maintaining the synchronicity between the tubular bag machine and the dosing device is extremely complex. To provide for the required dosing power, high-performance dosing devices must be used, which are quite expensive and high-maintenance.

Another disadvantage of the synchronous operation between the tubular bag machine and the dosing device is that according to the known state of the art, the dosing device must be disposed above the filling device. Since the dosing device requires an ever-increasing assembly space for maintaining the required dosing performance, the height of the space required for the assembly of the tubular bag machine with the dosing device disposed above it increases continuously.

Based on this state of the art, it is therefore the object of the disclosure to propose a new twin-tube tubular bag machine which prevents the disadvantages of the state of the art mentioned above.

Advantageous embodiments of the disclosure are the subject matter of the dependent claims.

The fundamental concept of the twin-tube tubular bag machine according to the disclosure is based on a transfer element having several transfer containers being provided between the two filling devices of the twin-tube tubular bag machine and the dosing device. In other words, the dosing of the necessary filling quantity of the filling material is no longer carried out by directly dispensing the filling material from the dosing device into the two filling devices of the tubular bag machine. Instead, the transfer element comprises an input station, in which the prespecified filling quantities for each filling of the individual tubular bags are transferred from the dosing device to one transfer container each. Subsequently, the transfer containers are transported to two dispensing stations along a transfer line. Then, the transfer containers are emptied into the dispensing stations and the filling material is transferred from the transfer containers to the two filling device of the tubular bag machine. Subsequently, the transfer container returns to the input station along a return transfer line where it can be filled once again by the dosing device.

As a result, the dosing process is decoupled from the tubular bag filling process by means of the transfer element, such that the dosing device and the tubular bag machine no longer necessarily have to be operated synchronously. This decoupling in particular allows that interferences in one of the two processes do not directly cause an interference in the other process. Additionally, the transfer element allows the dosing device to operate irrespective of the position on the tubular bag machine, such that a position of the dosing device above the filling device of the tubular bag machine is not necessarily required.

The disclosure can also decrease the height at which the product is dropped and increase the performance of the process. The protection of fragile products is also increased. Transfer containers whose diameter is not consistent can be used in order to increase the emptying speed. By decoupling the dosing process and the bag-filling process, the speed of the filling process can be increased by optimized speed controls and improved opening methods.

It is especially advantageous if the distance between the two dispensing stations is adaptable. In this manner, the geometry of the dispensing stations can be matched to the adaptable geometry of the twin-tube tubular bag machine. In particular when the distance between the filling devices is changed, this can be compensated by changing the distance between the two dispensing stations. In general, any type of tubular bag machine can be combined with the transfer element. When using a vertical twin-tube tubular bag machine, disposing the transfer element between the dosing device and the tubular bag machine is especially advantageous.

The filling device can generally have any form. According to a preferred embodiment, the filling device is realized in the manner of a forming tube, the film tube being guided on the outer surface of the forming tube. Under the influence of gravity, the filling material can then be filled into the still unsealed tubular bag from above through the internal cross section of the forming tube.

There are different embodiments for each dosing device to be used. Generally, any gravimetric or volumetric dosing device or any dosing device using a metering method can be used. Depending on how the dosing is carried out, a weighing scale or a screw conveyor or a meter or a volume dosing element can be used as a dosing device.

In view of the dosing process being decoupled from the tubular bag filling process, it is especially advantageous if the transfer element is controlled by a separate control system. This transfer control system can control the transfer process in the input station irrespective of the transfer process in the dispensing station, such that the two processes are truly decoupled.

In view of correcting little process interferences, it is especially advantageous if the transfer control system can change the conveying speed of the transfer containers along the transfer line and/or along the return transfer line. In particular short delays in the area of the dosing can easily be compensated by means of such speed variations in order to ensure that the pre-dosed amount of the filling material in the dispensing station is timely dispensed, even in the event of little process interferences.

It is especially advantageous if the transfer control system can change the conveying speed of individual transfer containers irrespective of the conveying speed of the other transfer containers.

In order to be able to also compensate for larger process interferences and related process deviations between the dosing process and the tubular bag filling process, the transfer element can be equipped with at least one buffer. In this buffer, at least one filled or unfilled transfer container can be stored temporarily. In the event of a little process interference which, for example, prevents the transfer container from being filled on time, the transfer container temporarily stored in the buffer can be extracted and introduced to the transfer line or the return transfer line. In particular, it can be advantageous to provide a buffer upstream of each dispensing station.

In the basic form of the disclosure, a dosing device is connected to a twin-tube tubular bag machine by means of the transfer element. According to a preferred embodiment, however, the transfer element comprises at least two input stations, at each of which filling material can be transferred from a dosing device to the transfer containers. In this manner, the required dosing performance can in particular be distributed among several dosing devices, such that for example a high-performance twin-tube tubular bag machine comprising two or more dosing devices can be provided with the pre-dosed filling quantities. The individual dosing devices can then each have a correspondingly smaller dosing performance, such that high-performance dosing devices are not required in particular for the dosing of high-performance twin-tube tubular bag machines.

The dosing of the filling material by means of several dosing devices and their transfer to the transfer containers at a minimum of two different input stations is in particular advantageous if the tubular bags are to be filled with a mixed filling, for example a nut mix. To mix this filling, different filling materials can be transferred to the transfer containers at the different input stations, whereby the individual transfer containers then receive the corresponding, desired mix of the filling material when arriving at the dispensing station. By individually dosing the sub-components which make up the mix, the dosing accuracy of the proportions of the sub-components in the mix is moreover increased.

Alternatively or additionally to using several input stations, the transfer element can also comprise more than one paring of two dispensing stations. At each pairing of two dispensing stations each, the filling material or the material mix can be transferred from the transfer containers to the filling devices of different twin-tube tubular bag machines. By means of corresponding transfer elements, even complex transfer systems, in which a plurality of possibly different dosing devices can be linked to a plurality of different tubular bag machines, can be formed in this manner, thus enabling an optimized capacity alignment between the dosing capacities and the filling capacities.

Different embodiments of the disclosure are schematically illustrated in the drawings and are described in an exemplary manner hereinafter.

Figure 4:
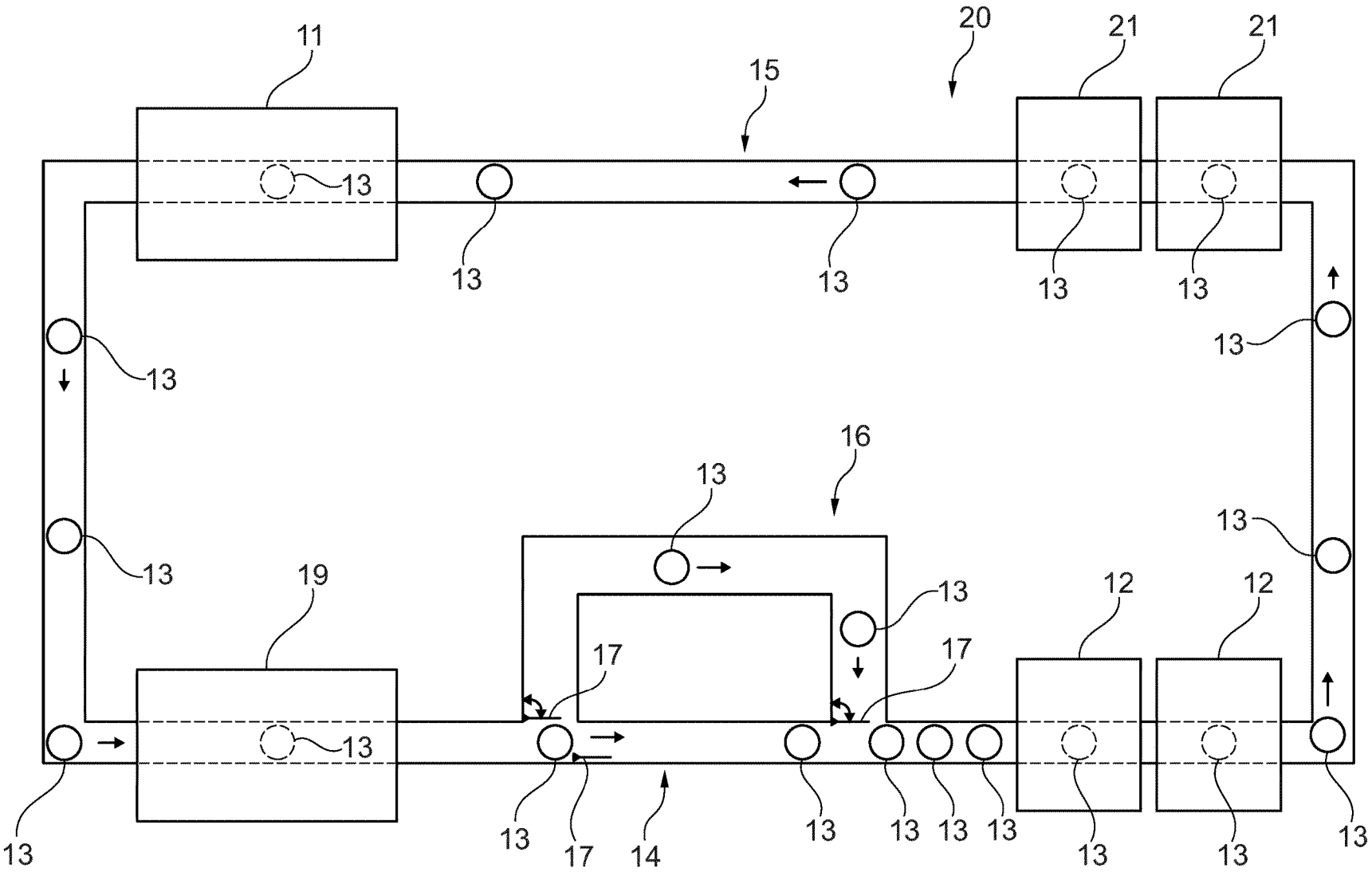

FIG. 4 a third embodiment of a transfer element in a top view.

Figure 1:
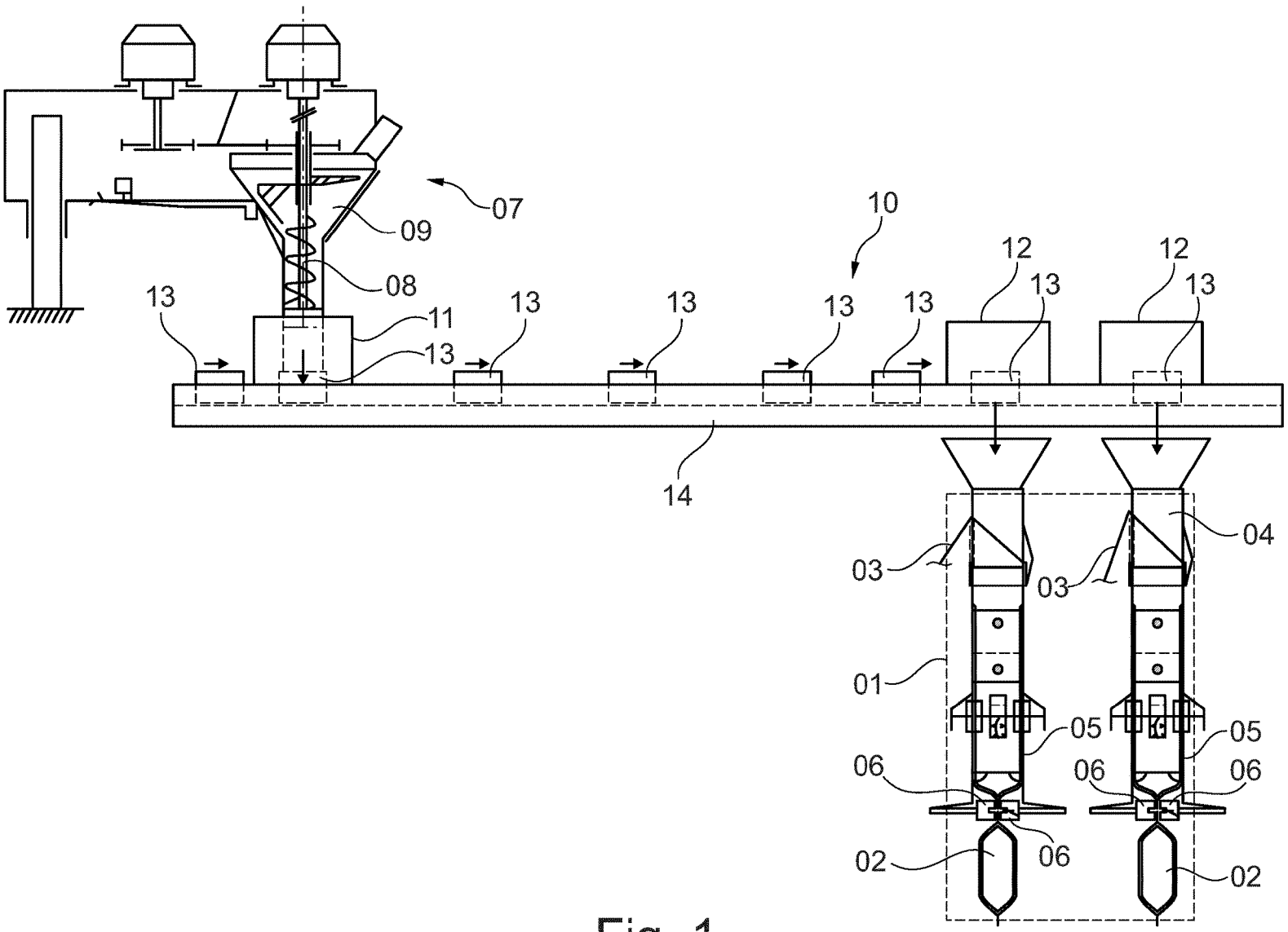
FIG. 1 shows a twin-tube tubular bag machine having a dosing device disposed upstream thereof and a transfer element disposed therebetween in a side view.

FIG. 1 shows a twin-tube tubular bag machine 01 for producing tubular bags 02. In the production of tubular bags 02, one packaging film 03 is first formed around each of the two filling devices 04, which are formed in the manner of forming tubes, to one tube each and is then sealed longitudinally. Thus formed film tubes 05 are sealed transversely by means of transverse sealing jaws 06 and are thus closed at the upper or lower end. Tubular bags 02, which have not been closed at the upper end thus far, in the two tubular bag strands are filled with a filling material by filling devices 04 during the filling process in the twin-tube tubular bag machine 01, the filling material falling into the still open tubular bag from above through the internal cross section of the forming tubes.

A dosing device 07 is disposed upstream of twin-tube tubular bag machine 01, said dosing device 07 being formed in the manner of a dosing screw 08 having a corresponding drive in the illustrated embodiment. By suitably driving dosing screw 08, a prespecified filling volume of the filling material can be discharged from a filling material funnel 09.

A transfer element 10 is disposed between twin-tube tubular bag machine 01 and dosing device 07. Transfer element 10 comprises an input station 11 and two dispensing stations 12. Transfer containers 13 of dosing device 07 can be filled with the pre-dosed amount of the filling material in input station 11. Subsequently, transfer containers 13 are transported along a transfer line 14 to dispensing stations 12. Transfer containers 13 are emptied into dispensing station 12, such that the prespecified amount of the filling material falls into the open tubular bags from above through filling devices 04. In this case, transfer containers 13 are filled in input station 11 irrespective of the emptying of transfer containers 13 in dispensing stations 12, such that a synchronicity between the dosing process in dosing device 07 and the tubular bag filling process in tubular bag machine 01 is no longer required. By varying the conveying speed of transfer containers 13 along transfer line 14, synchronicity deviations between the two processes can be easily compensated.

Figure 2:
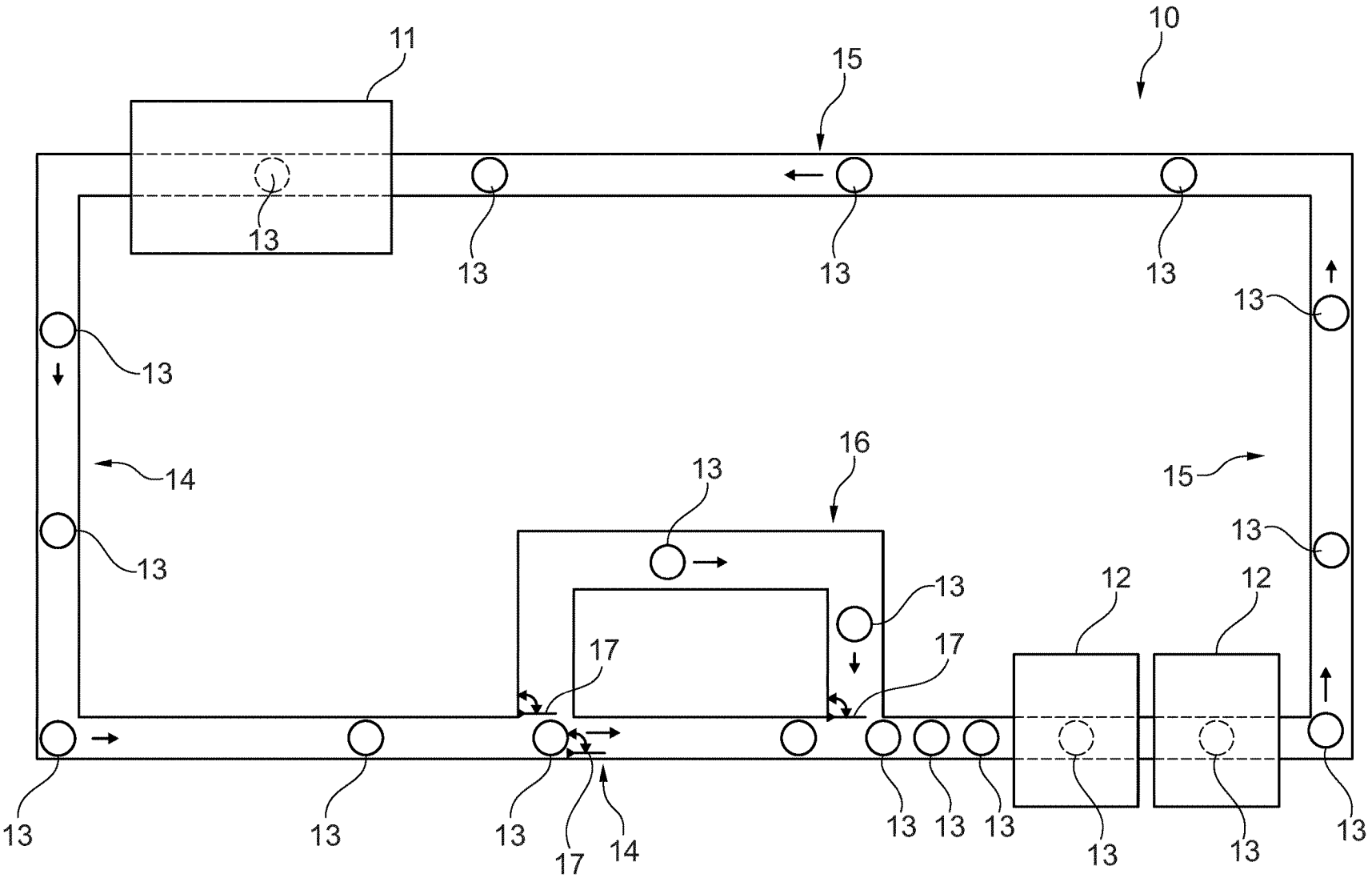
FIG. 2 shows the transfer element according to FIG. 1 in a top view.

FIG. 2 shows transfer element 10 having input station 11 and the two dispensing stations 12 in a schematic top view. As can be seen in FIG. 2, transfer containers 13 are transported back to input station 11 along a return transfer line 15 after the emptying into the dispensing stations 12, such that they can be filled there once again with a pre-dosed amount of the filling material. In order to also compensate for larger synchronicity deviations between the filling of the transfer containers in input station 11 and the emptying of transfer containers 13 into the two dispensing stations 12, transfer line 14 also comprises a buffer 16 in which several transfer containers 13 can be stored temporarily. Switch elements 17 serve for filling or emptying transfer containers 13 in buffer 16.

Figure 3:
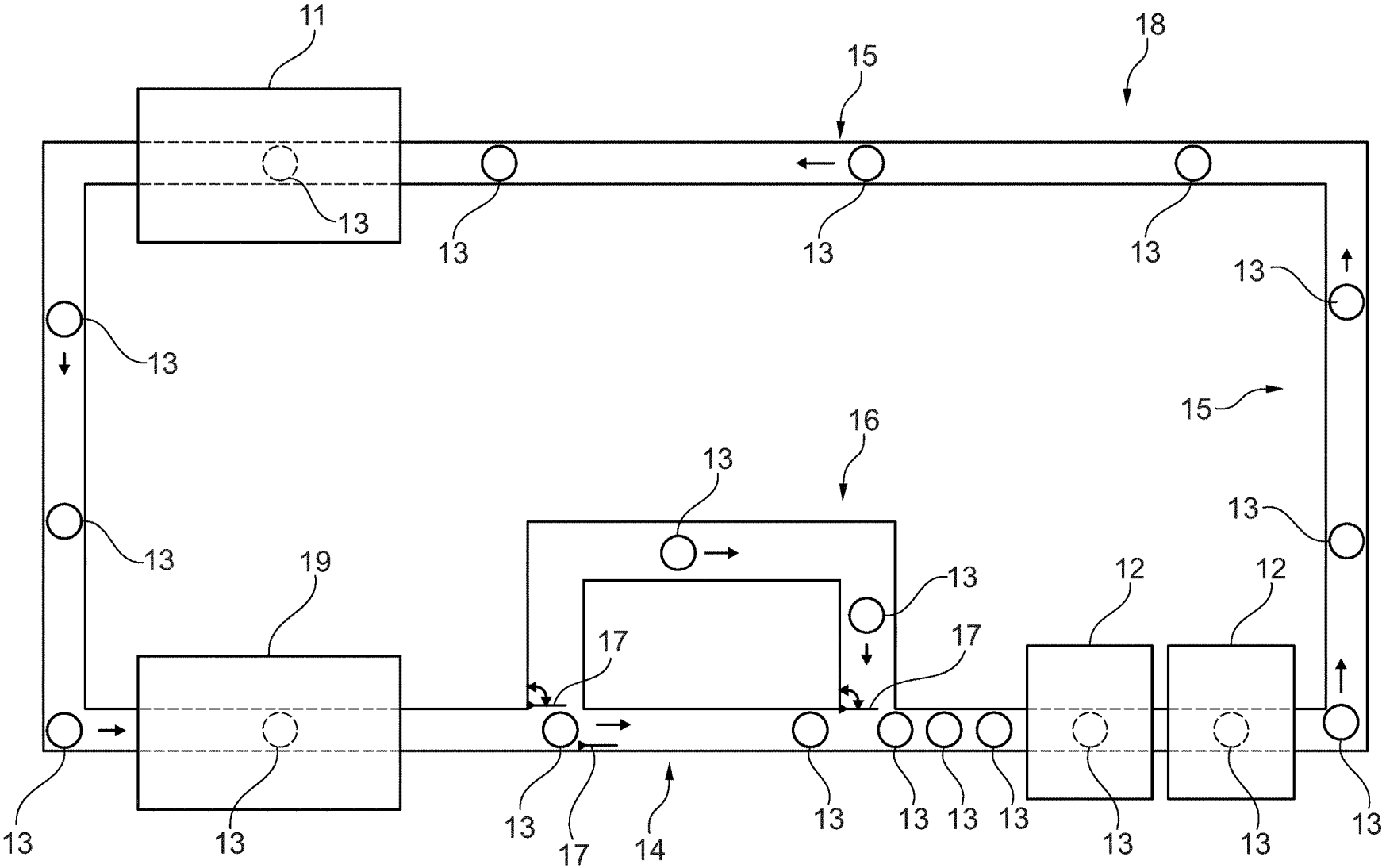
FIG. 3 shows a second embodiment of a transfer element in a top view.

FIG. 3 shows an alternative embodiment of a transfer element 18. The basic design of transfer element 18 corresponds to the design of transfer element 10, transfer element 18 comprising an additional input station 19. In turn, transfer containers 13 can be filled with pre-dosed filling quantities of a filling material at additional input station 19 using an additional dosing device 07. It is conceivable that different transfer containers are each filled with filling material in input stations 11 and 19 in order to increase the required dosing capacity in this manner by using two dosing devices. Alternatively, transfer containers 13 can also each be filled with different filling materials in input stations 11 and 19, such that each transfer container contains a pre-dosed mix of filling materials after leaving input station 19.

FIG. 4 shows a third embodiment of a transfer element 20. Transfer element 20 differs from transfer element 18 in that an additional pairing of two dispensing stations 21 is used. As a result, transfer containers 13 can, on the one hand, be filled with filling material in input stations 11 and 19 by means of transfer element 20 using different dosing devices and then, the filling materials can be dispensed to two different twin-tube tubular bag machines 01 from transfer containers 13 at the two pairings of two dispensing stations 12 and 21 each. In so far as the transfer elements comprise additional input stations or dispensing stations, more complex transfer systems, which are made of a plurality of dosing devices and a plurality of tubular bag machines, can be realized.

The invention claimed is:

1. A twin-tube tubular bag machine having two longitudinal sealing elements for forming two parallel film tubes, two transverse sealing jaws, which are moveable against each other and which thereby transversely seal the film tube, being provided for each of the two film tubes for forming sealed tubular bags, having a mechanism which has a drive and which moves the transverse sealing jaws, and having two filling devices for filling the tubular bags formed by the film tubes with filling material, and having two separating elements for separating individual filled tubular bags from the two film tubes, a dosing device being disposed upstream of each of the filling devices, said dosing device allowing for the dosing of a prespecified filling quantity of the filling material to be filled into the tubular bags, wherein a transfer element having a transfer line, a return transfer line, and several transfer containers is provided between the two filling devices and the dosing device, the prespecified filling quantity of the filling material being transferred from the dosing device to the transfer containers in an input station, and the transfer containers being transported to a pairing of two dispensing stations, the two dispensing stations arranged sequentially along the transfer line, and the filling material being transferred from the transport containers to the two filling devices in the pairing of two dispensing stations, and the transfer containers being transported back to the input station along the return transfer line, and wherein the transfer element is controlled by a transfer control system, the transfer control system controlling the transfer process in the input station irrespective of the transfer process in the dispensing stations.

2. The twin-tube tubular bag machine according to claim 1, wherein in a pairing of two dispensing stations, the distance between the two dispensing stations is adaptable.

3. The twin-tube tubular bag machine according to claim 1, wherein the twin-tube tubular bag machine is a vertical twin-tube tubular bag machine.

4. The twin-tube tubular bag machine according to claim 1, wherein the filling devices are each realized in the manner of a forming tube, the film tubes being guided on the outer surface of the forming tubes.

5. The twin-tube tubular bag machine according to claim 1, wherein the dosing device comprises at least a weighing scale or at least a screw conveyor or at least a meter or at least a volume dosing device for measuring the filling material.

6. The twin-tube tubular bag machine according to claim 1, wherein the transfer control system changes the conveying speed of the transfer containers along the transfer line and/or along the return transfer line.

7. The twin-tube tubular bag machine according to claim 6, wherein the transfer control system changes the conveying speed of individual transfer containers irrespective of the conveying speed of the other transfer containers.

8. The twin-tube tubular bag machine according to claim 1, wherein the transfer element comprises at least one buffer, which temporarily stores at least one filled or unfilled transfer container.

9. The twin-tube tubular bag machine according to claim 1, wherein the transfer element comprises at least two input stations, at each of which filling material from a dosing device is transferable to the transfer containers.

10. The twin-tube tubular bag machine according to claim 9, wherein for forming a mixed filling at the different input stations, different filling materials are transferable to a transfer container.

11. The twin-tube tubular bag machine according to claim 1, wherein the transfer element comprises at least two pairings of two dispensing stations each, at which filling material from the transfer containers is transferable to the two filling devices of different twin-tube tubular bag machines.

* * * * *